US007533468B1

(12) United States Patent
Hinkle

(10) Patent No.: US 7,533,468 B1
(45) Date of Patent: May 19, 2009

(54) MOSS REMOVAL TOOL

(76) Inventor: Charles Hinkle, 1102 Dondea St., Springfield, OR (US) 97478

( * ) Notice: Subject to any disclaimer, the term of this patent is extended or adjusted under 35 U.S.C. 154(b) by 326 days.

(21) Appl. No.: 11/618,959

(22) Filed: Jan. 2, 2007

(51) Int. Cl.
*B26B 5/00* (2006.01)

(52) U.S. Cl. ..... 30/169; 30/315; 30/337

(58) Field of Classification Search ..... 30/169, 30/172, 314, 329, 337, 338, 294, 280, 315; 15/236.01; 173/13; 294/49
See application file for complete search history.

(56) References Cited

U.S. PATENT DOCUMENTS

| | | | | |
|---|---|---|---|---|
| 2,561,336 | A * | 7/1951 | Bucsko et al. | 30/280 |
| 2,674,005 | A * | 4/1954 | Simon | 15/105 |
| 3,091,790 | A | 6/1963 | Schroeder | |
| 3,892,039 | A * | 7/1975 | Fisher | 30/279.2 |
| 3,981,043 | A * | 9/1976 | Curry | 16/430 |
| 4,037,668 | A * | 7/1977 | Svejda | 172/371 |
| 4,477,972 | A | 10/1984 | Testa, Jr. | |
| 4,694,576 | A * | 9/1987 | Cothery | 30/280 |
| 4,791,780 | A | 12/1988 | Phillips | |
| 5,305,584 | A | 4/1994 | Hessabi | |
| D377,140 | S | 1/1997 | Bair | |
| 5,782,853 | A * | 7/1998 | Zeevi et al. | 606/187 |
| 6,018,894 | A | 2/2000 | Whitehead et al. | |
| 6,494,963 | B1 * | 12/2002 | Holly | 134/6 |
| 2001/0045293 | A1 | 11/2001 | Tam | |
| 2002/0190145 | A1 | 12/2002 | Sheppard, Jr. | |
| 2005/0060977 | A1 | 3/2005 | Coyne et al. | |
| 2006/0124325 | A1 * | 6/2006 | Howells | 172/371 |
| 2008/0257575 | A1 * | 10/2008 | Howells | 172/371 |

* cited by examiner

*Primary Examiner*—Hwei-Siu C Payer

(57) ABSTRACT

A moss removal tool includes an elongate handle that has a first end and a second end. The first end has a slot therein that separates the handle into a first portion and a second portion. A blade member has middle plate and a pair of lateral walls that are attached to and are coextensive with the middle plate. The blade member has front and rear edges. The rear edge is positioned in the slot and the front edge extends outwardly away from the first end. The blade member has an I-shaped cross-section taken perpendicular to a longitudinal axis of the blade member. A locking member is mounted on the handle and is configured to bias the first and second portions against the blade member to secure the blade member to the handle. The front edge may be moved along shingles to scrape moss off of the shingles.

9 Claims, 3 Drawing Sheets

MOSS REMOVAL TOOL

BACKGROUND OF THE INVENTION

1. Field of the Invention

The present invention relates to moss removing devices and more particularly pertains to a new moss removing device for removing moss from the shingles of a dwelling without damaging the shingles.

2. Description of the Prior Art

The use of moss removing devices is known in the prior art. While these devices fulfill their respective, particular objectives and requirements, the need remains for a device to remove moss from shingles either before or after it has been killed with a herbicide. Even if the moss is killed with a herbicide, it remains under and lifts the edges of the shingles which can eventually lead to shingle failure and water damage. However, no current tools exist for the easy removal of the moss from the shingles without damaging the shingles. Therefore a tool is needed that is efficient at scraping the moss from the shingles which does not damage the shingles when the moss is being removed.

SUMMARY OF THE INVENTION

The present invention meets the needs presented above by generally comprising an elongate handle that has a first end and a second end. The first end has a slot therein that separates the handle into a first portion and a second portion adjacent to the first end. A blade member has middle plate and a pair of lateral walls that are attached to and are coextensive with the middle plate. The blade member has a front edge and a rear edge. The rear edge is positioned in the slot and the front edge extends outwardly away from the first end. The blade member has an I-shaped cross-section taken perpendicular to a longitudinal axis of the blade member. A locking member is mounted on the handle and is configured to bias the first and second portions against the blade member to secure the blade member to the handle. The front edge may be moved along shingles to scrape moss off of the shingles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
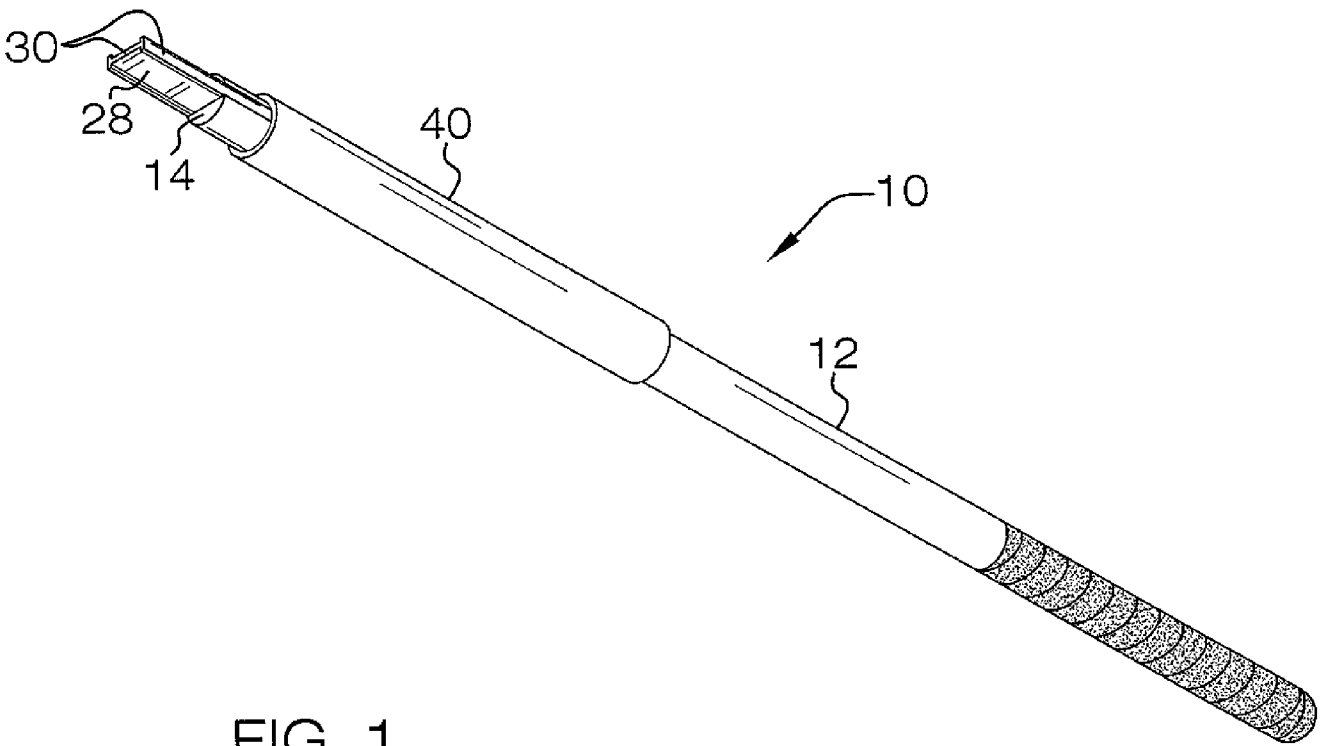
FIG. 1 is a perspective view of a moss removal tool according to the present invention.
Figure 2:
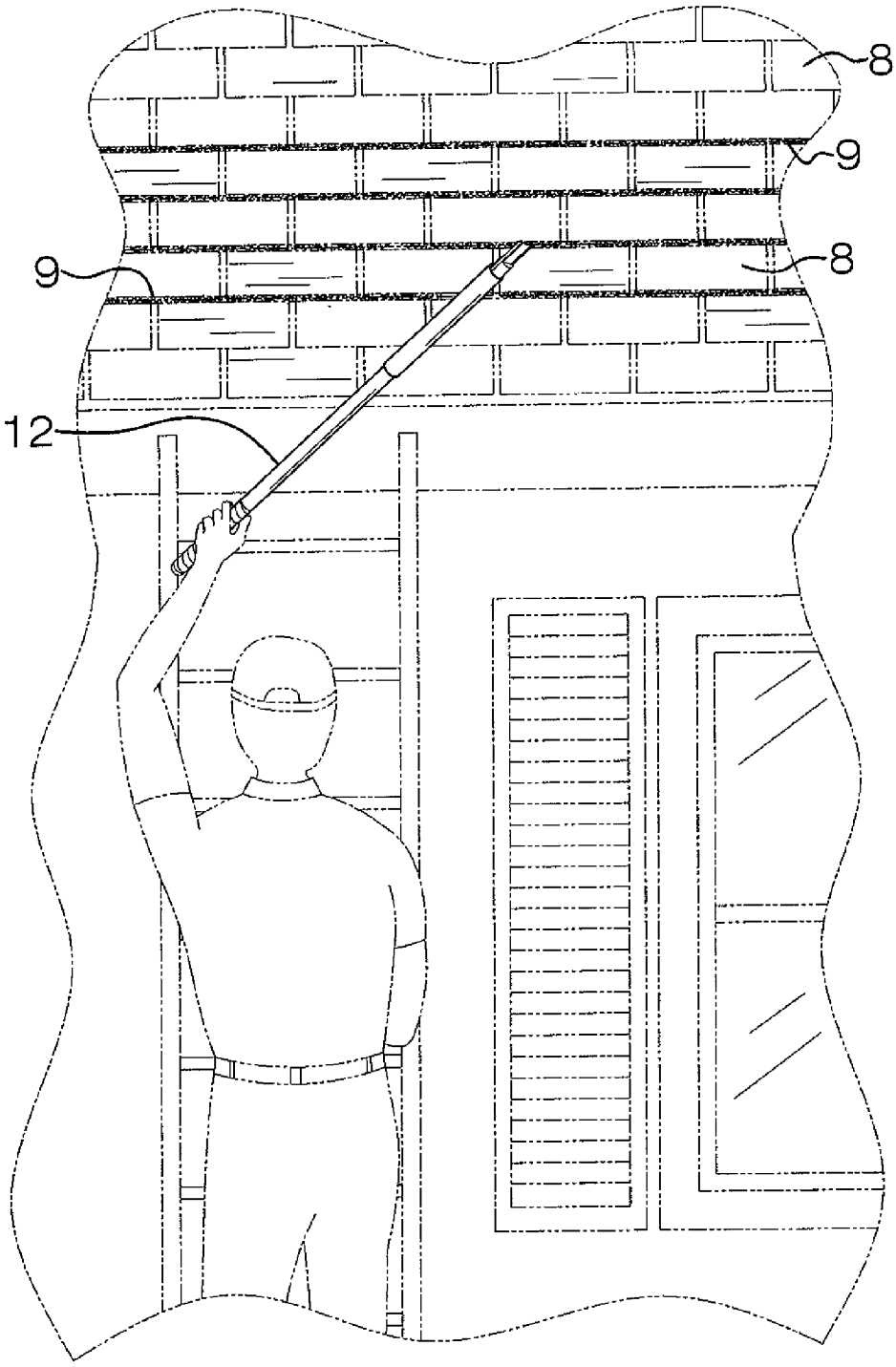
FIG. 2 is an in-use view of the present invention.
Figure 3:
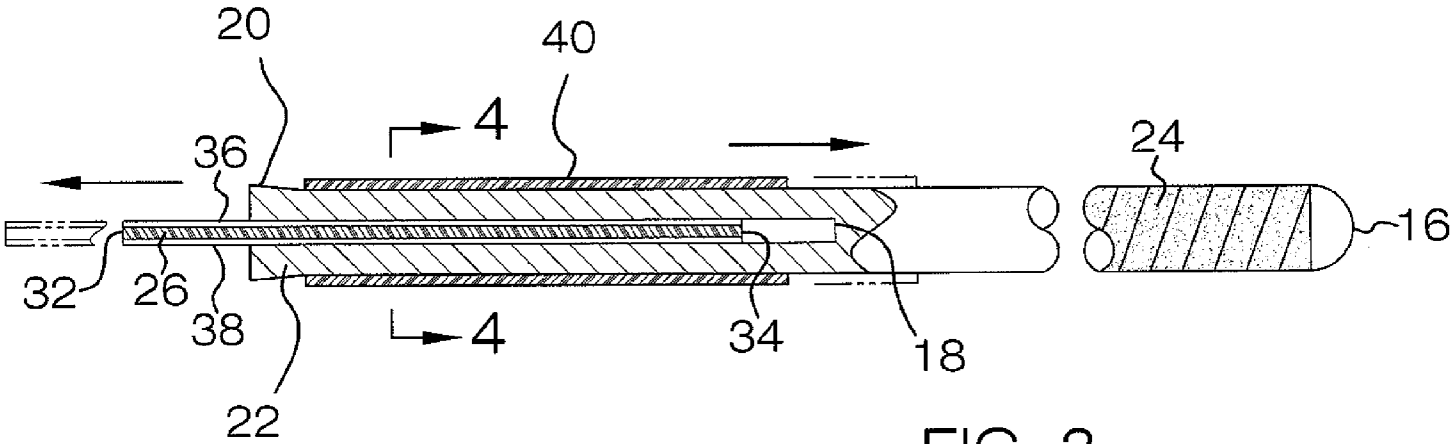
FIG. 3 is a cross-sectional view of the present invention.
Figure 4:
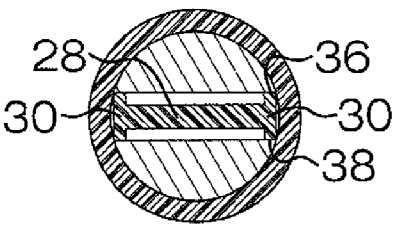
FIG. 4 is a cross-sectional view taken along line 4-4 of FIG. 3 of the present invention.

With reference now to the drawings, and in particular to FIGS. 1 through 4 thereof, a new moss removing device embodying the principles and concepts of the present invention and generally designated by the reference numeral 10 will be described.

As best illustrated in FIGS. 1 through 4, the moss removal tool 10 generally comprises an elongate handle 12 that has a first end 14 and a second end 16. The first end 14 has a slot 18 therein and separates the handle 12 into a first portion 20 and a second portion 22 adjacent to the first end 14. The slot 18 extends between 1 inch and 12 inches toward the second end from the first end 14. A grip 24 is attached to the handle 12 adjacent to the second end 16.

A blade member 26 has middle plate 28 and a pair of lateral walls 30 that are attached to and are coextensive with a length of the middle plate 28. The blade member 26 has a front edge 32 and a rear edge 34. The rear edge 34 is positioned in the slot 18 and the front edge 32 extends outwardly away from the first end 14. The blade member 26 has a longitudinal axis extending through the front 32 and rear 34 edges thereof. The blade member 26 has an I-shaped cross-section taken perpendicular to the longitudinal axis of the blade member 26. Each of the lateral walls 30 has an upper edge 36 and a lower edge 38. The middle plate 28 is approximately equally spaced from the upper 36 and lower 38 edges. Each of the lateral walls 30 has a height dimension approximately equal to ¼ inch and a width dimension approximately equal to ⅛ inch. The middle plate 28 has a width dimension between the lateral walls 30 equal approximately to 1¼ inches. The middle plate 28 has a height dimension equal approximately to ⅛ inch. The height dimensions of the lateral walls 30 ensure that they may adequately scrape under the edges of shingles 8.

The blade member 26 is comprised of a resiliently flexible plastic material. The plastic material cannot be rigid and durable as the blade member 26 will be scraped along shingles 8. By being resiliently flexible, the blade member 26 will not damage the shingles 8 and will wear away so that the front edge 32 is rounded and will more easily be extended under the edges of the shingles 8. The front edge 32 may be provided in a rounded shaped but the plastic material will continue to be of a material such as polyvinyl chloride (PVC) which will not damage the shingles.

A locking member 40 is mounted on the handle 12 and is configured to bias the first 20 and second 22 portions against the blade member 26 to secure the blade member 26 to the handle 12. The locking member 40 comprises a collar slidably positioned on the handle member 12 and is positionable over the first 20 and second portions 22.

In use, the front edge 32 is moved along the shingles 8 to scrape the moss 9 off of the shingles 8. The moss 9 may be killed first, with a herbicide, and the dead moss 9 then scraped from between the shingles 8. The shape and composition of the blade 26 ensures that the moss 9 may be easily removed without damaging the shingles 9.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A moss removal tool apparatus to facilitate the removal of moss from shingles, said apparatus comprising:

an elongate handle having a first end and a second end, said first end having a slot therein and separating said handle into a first portion and a second portion adjacent to said first end;

a blade member having a middle plate and a pair of lateral walls being attached to and being coextensive with said middle plate, said blade member having a front edge and a rear edge, said rear edge being positioned in said slot and said front edge extending outwardly away from said first end, said blade member having an I-shaped cross-section taken perpendicular to a longitudinal axis of said blade member;

a locking member being mounted on said handle and being configured to bias said first and second portions against said blade member to secure said blade member to said handle; and wherein said front edge can be moved along the shingles to scrape the moss off of said shingles.

2. The apparatus according to claim 1, further including a grip being attached to said handle adjacent to said second end.

3. The apparatus according to claim 1, wherein each of said lateral walls has an upper edge and a lower edge, said middle plate being approximately equally spaced from said upper and lower edges.

4. The apparatus according to claim 3, wherein each of said lateral walls has a height dimension approximately equal to ¼ inch and a width dimension approximately equal to ⅛ inch.

5. The apparatus according to claim 4, wherein said middle plate has a width dimension between said lateral walls equal approximately to 1¼ inches, said middle plate having a height dimension equal approximately to ⅛ inch.

6. The apparatus according to claim 4, wherein said blade member is comprised of a resiliently flexible plastic material.

7. The apparatus according to claim 1, wherein said blade member is comprised of a resiliently flexible plastic material.

8. The apparatus according to claim 1, wherein said locking member comprises a collar slidably positioned on said handle member and being positionable over said first and second portions.

9. A moss removal tool apparatus to facilitate the removal of moss from shingles, said apparatus comprising:

an elongate handle having a first end and a second end, said first end having a slot therein and separating said handle into a first portion and a second portion adjacent to said first end, said slot extending between 1 inch and 12 inches toward said second end from said first end;

a grip being attached to said handle adjacent to said second end;

a blade member having a middle plate and a pair of lateral walls being attached to and being coextensive with said middle plate, said blade member having a front edge and a rear edge, said rear edge being positioned in said slot and said front edge extending outwardly away from said first end, said blade member having an I-shaped cross-section taken perpendicular to a longitudinal axis of said blade member, each of said lateral walls having an upper edge and a lower edge, said middle plate being approximately equally spaced from said upper and lower edges, each of said lateral walls having a height dimension approximately equal to ¼ inch and a width dimension approximately equal to ⅛ inch, said middle plate having a width dimension between said lateral walls equal approximately to 1¼ inches, said middle plate having a height dimension equal approximately to ⅛ inch, said blade member being comprised of a resiliently flexible plastic material;

a locking member being mounted on said handle and being configured to bias said first and second portions against said blade member to secure said blade member to said handle, said locking member comprising a collar slidably positioned on said handle and being positionable over said first and second portions; and wherein said front edge can be moved along the shingles to scrape the moss off of said shingles.

* * * * *